US006035866A

United States Patent [19]

Seneco et al.

[11] Patent Number: 6,035,866

[45] Date of Patent: Mar. 14, 2000

[54] POMADE STICK APPLICATOR WITH RESILIENT SEALING FEATURES

[75] Inventors: Vincent C. Seneco, Oakville; William Kezema, Jr., Southbury, both of Conn.

[73] Assignee: Eyelematic Manufacturing Co., Inc., Watertown, Conn.

[21] Appl. No.: 09/146,676

[22] Filed: Sep. 3, 1998

[51] Int. Cl.[7] ..... A45D 40/24; A45D 33/28; A45D 40/20; B43K 21/08

[52] U.S. Cl. ..... 132/318; 132/317; 132/297; 401/78; 401/86

[58] Field of Search ..... 132/317, 318, 132/297; 401/78, 86, 74, 77, 80, 87, 98; 206/56

[56] References Cited

U.S. PATENT DOCUMENTS

| | | | |
|---|---|---|---|
| 2,442,109 | 5/1948 | Anderson | 401/78 |
| 2,840,229 | 6/1958 | HopGood | 401/78 |
| 2,840,231 | 6/1958 | Reichenbach | 401/78 |
| 4,792,251 | 12/1988 | Ryder . | |
| 4,812,066 | 3/1989 | Gueret | 401/78 |
| 4,884,912 | 12/1989 | Guret | 401/78 |
| 4,961,663 | 10/1990 | Iwamoto et al. . | |
| 5,234,275 | 8/1993 | Gueret . | |
| 5,324,126 | 6/1994 | Holloway et al. . | |
| 5,348,410 | 9/1994 | Shozi et al. . | |
| 5,597,252 | 1/1997 | Ito et al. . | |

*Primary Examiner*—John J. Wilson
*Assistant Examiner*—Robyn K. Doan
*Attorney, Agent, or Firm*—Ware Fressola Van der Sluys & Adolphson LLP

[57] ABSTRACT

A pomade stick applicator having a swiveling pomade advancing and retracting mechanism has a two-part base-cap container and virtually air-tight sealing features. These include an interfering snap fit between the container base and the longitudinally slotted inner body, and a resiliently deformable annular seal between the lower end of the helical internal cam and the inner body. This annular seal is urged into telescoping deformed sealed engagement by the container cap applied by the user. The interior of the cap seals the upper end of the shell fixed to the cam, and also provides an inner skirt interferingly telescoped with the upper end of the inner body, prevening swiveling. These seals enclose the pomade stick, blocking the escape of volatiles.

11 Claims, 3 Drawing Sheets

POMADE STICK APPLICATOR WITH RESILIENT SEALING FEATURES

This invention relates to pomade stick applicators having swiveling pomade advancing and retracting mechanisms, and particularly to such applicators incorporating sealing features minimizing the evaporation of volatile ingredients from the pomade stick.

Most such applicators for pomade sticks of lipstick, antiperspirants, insect repellents or adhesive pastes have separable two-part base-and-cap containers, and incorporate internal helical cam tracks co-acting with longitudinal slots in a base-mounted inner body to elevate and lower a pomade-supporting elevator cup upon relative rotation of the base and the cam by the user.

Recently developed soft pomade formulations utilize volatile solvents to maintain the desired homogeneous distribution of active and inactive ingredients throughout the soft pomade stick. Such volatile solvents evaporate more readily than did conventional pomade ingredients in the past, producing undesirable shrinkage of the pomade sticks. This shrinkage has caused pomade sticks to detach themselves from their elevator cups, and drop out of the applicator, destroying the utility of the product before the pomade has been used up to the desired extent.

Pomade applicator features to retard such evaporation of volatiles such as soft, flexible O-ring gaskets and the like have been proposed, in such U.S. Patents as Gueret U.S. Pat. No. 4,812,066; Gueret U.S. Pat. No. 5,234,275; Ryder U.S. Pat. No. 4,792,251; Iwamoto U.S. Pat. No. 4,961,663; Ito U.S. Pat. No. 5,597,252; and Japanese patent 08019421.

These proposals have produced incomplete sealing against evaporation of volatiles. The cooperating internal applicator-sealing features of the present invention, as well as those base-cap container sealing features disclosed in the co-pending Velicka-Pfrommer application, Serial No. 09/148,387, filed Sep. 4, 1998 (WFVA Docket No. 3-351-16) have successfully achieved substantially airtight sealing of these pomade applicators. This sealing has minimized or virtually eliminated the undesired shrinkage of pomade sticks, even during extended periods of storage in inventory, or of non-use by the ultimate consumer. The useful life of these products and their value have thus been substantially increased by these sealing features.

BRIEF SUMMARY OF THE INVENTION

In the pomade applicators of this invention, three different types of internal sealing features are incorporated, all of them hidden by the container cap or base and thus not easily examined by inspection.

The longitudinally slotted inner body has its lower or proximal end anchored in torque transmitting engagement inside the container base by an annular rib and groove, providing a tight snap fit, substantially eliminating the escape of volatiles from inside the inner body via the interior of the container base.

In addition, the lower or proximal end of the tubular cam, encircling a shoulder protruding from the inner body near its proximal end, is forced into tight telescoping engagement with the shoulder when the container cap is firmly closed. Both cam and inner body are preferably molded of a material having significant resiliency. Their tight telescoping engagement deforms both components sufficiently to ensure their virtually airtight sealing engagement, substantially eliminating the escape of volatiles from inside the tubular cam.

The cam is anchored inside a tubular "A"-shell, normally of metal. The upper or distal end of this shell is enclosed by the container cap, which is provided with a flexible internal cap insert having a depending annular wall-flange anchored inside the cap's distal end, and also having an inwardly spaced depending skirt. This skirt extends downward inside the shell's distal end into interferingly deformed telescoping engagement inside the distal end of the inner body, resisting relative rotation of inner body and cam after the container cap is firmly installed in its closed position. This prevents undesired advance of the pomade stick inside the closed cap, protecting the stick from damage. At the same time the cap insert urges the shell-cam assembly firmly downward, assuring the desired tight telescoping proximal engagement of cam and inner body, producing the desired airtight seal, and the cap insert also seals the distal end of the shell against the escape of volatiles.

It is thus a principal object of the invention to minimize or eliminate evaporative escape of volatile components from the pomade stick enclosed inside the advance-retract mechanism of these pomade applicators.

Another object of the invention is to combine the torque transmitting anchoring of the inner body inside the container base with a snap fit airtight seal.

A further object of the invention is to provide an airtight seal between the cam's proximal end and the inner body by resiliently deformed telescoping engagement, which is assured by downward force applied by the container cap to the cam when the cap is firmly closed on the applicator.

Still another object of the invention is to provide an airtight seal preventing the escape of volatiles from inside the cap's distal end while also firmly resisting undesired advance of the pomade stick, whenever the cap is firmly closed.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

THE DRAWINGS

For a fuller understanding of the nature and objects of the invention, reference should be made to the following detailed description taken in connection with the accompanying drawings, in which FIG. 1 is an enlarged, exploded, cross-sectional elevation view of a first pomade stick applicator embodiment of this invention, with its container cap removed and its pomade stick retracted;

Figure 7:
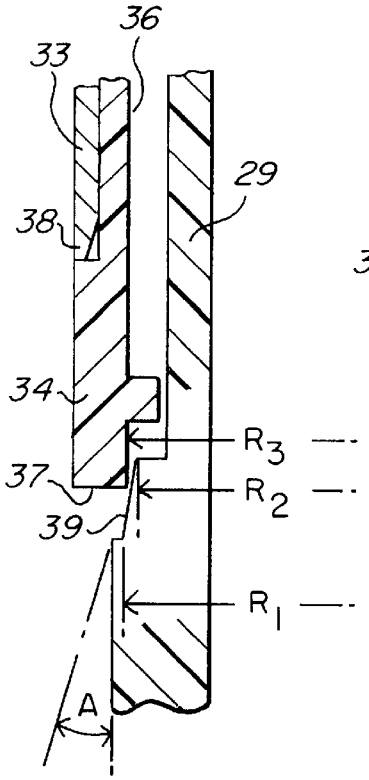
Figure 9:
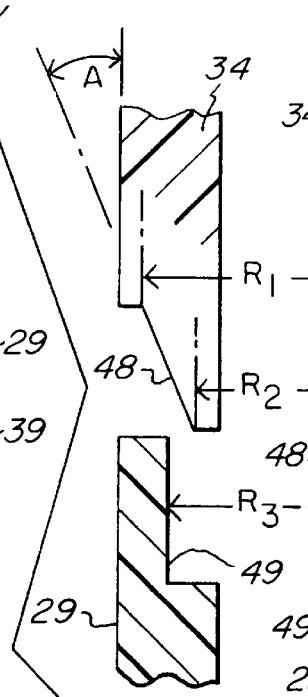
Figure 10:
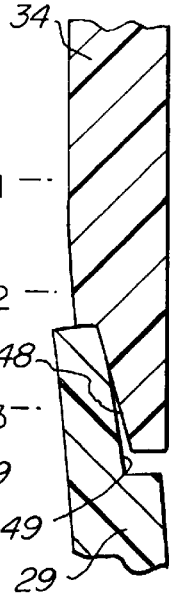
Figure 11:
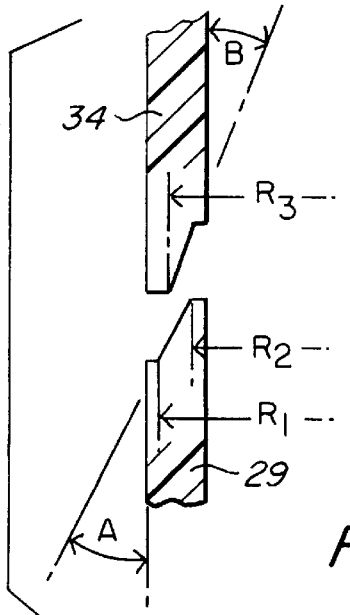
Figure 12:
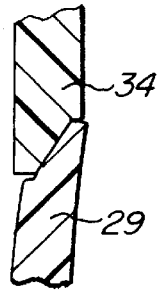
Figure 13:
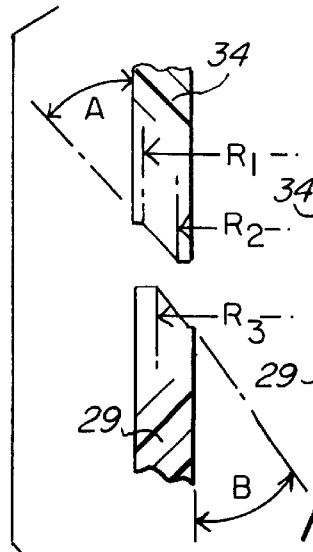
Figure 14:
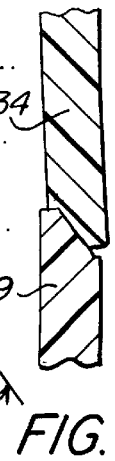

FIGS. 9, 11 and 13 are schematic views similar to FIG. 7, showing different embodiments of cam and inner body engaging surfaces; and FIGS. 10, 12 and 14 are similar schematic views of the engaging surfaces of respective FIGS. 9, 11 and 13, shown in their tight, fully telescoped proximal engagement.

BEST MODE FOR CARRYING OUT THE INVENTION

Figure 3:
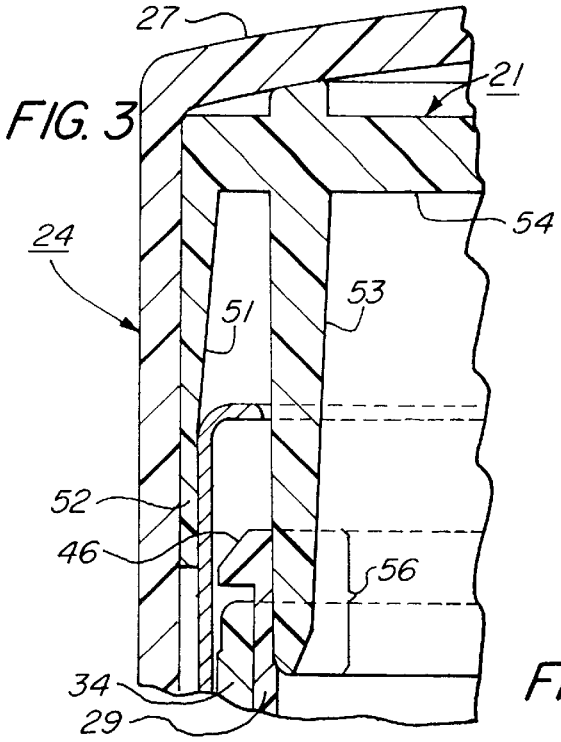
FIG. 3 is a similar greatly enlarged fragmentary cross-sectional elevation view of the upper left portion of FIG. 1, showing a first form of cap insert.
Figure 1:
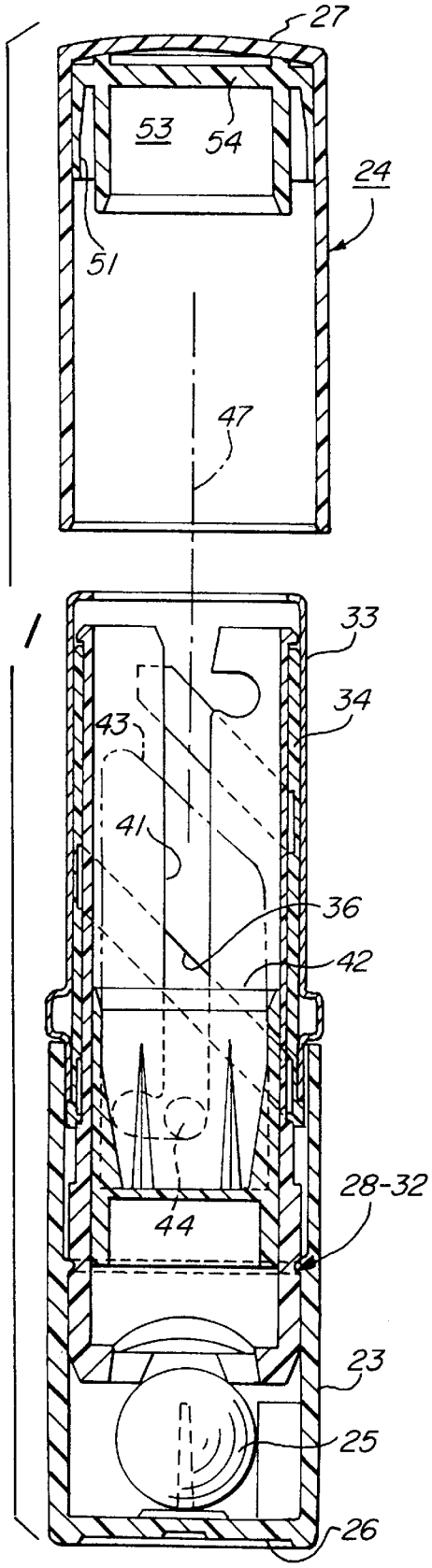
Figure 5:
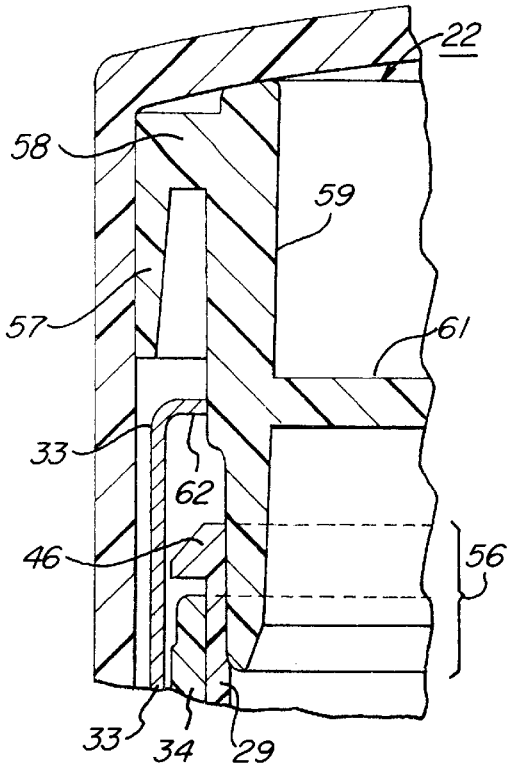
FIG. 5 is a greatly enlarged fragmentary cross-sectional elevation view of the upper left portion of FIG. 4, showing a second form of cap insert.
Figure 4:
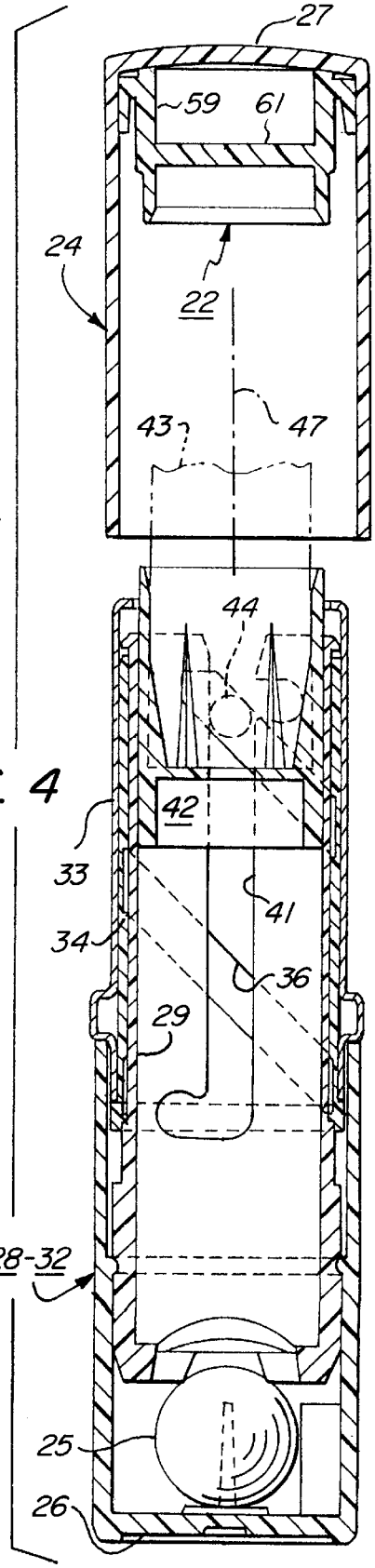
FIG. 4 is an enlarged, exploded, cross-sectional elevation view of a second pomade stick applicator embodiment of the invention, with its container cap removed and its pomade elevator cup raised to extend its pomade stick.

The two preferred embodiments of the pomade stick applicators of this invention are shown in the two exploded view of FIGS. 1 and 4. These embodiments are generally similar, differing only in the shapes of the resilient, deformable cap inserts 21 and 22, shown in greatly enlarged detail in FIGS. 3 and 5 respectively.

In FIGS. 1 and 4, the base-cap container 23–24 is comprised of a base 23 formed as a right circular cylinder with a closed lower "proximal" end 26, and a cap 24 formed as a matching right circular cylinder with a closed upper "distal" end 27. Since pomade stick applicators are customarily held upright while being opened by the user, in the positions shown in FIGS. 1 and 4, the terms "proximal" and "distal" identify the respective lower and upper portions of all components shown in these Figures.

Rib-and-Groove Assembly

Figure 6:
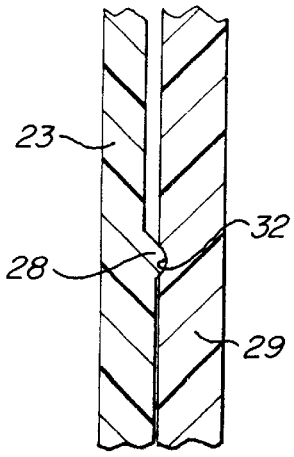
FIGS. 6 and 7 are corresponding greatly enlarged fragmentary cross-sectional elevation views of the respective lower left and left central portions of FIG. 4, showing additional sealing features.

As shown in FIG. 6, a rib-and-groove assembly 28–32 encircling the proximal end of an inner body 29 is comprised of a peripheral groove 31 formed in body 29, dimensioned for snap fit engagement with a mating rib protruding inward from the interior wall surface of base 23. Lowering insertion of inner body 29 into base 23 until the snap fit is achieved assures firm anchoring of a spherical weight, preferably a steel ball 25 between cap 23 and inner body 29, for stability and applicator heft. Base Ribs may contact inner body to help transmit torque. Snap fit also provides a firmly anchored torque transmitting relationship between the base 23 and the inner body 29. This snap fit also produces a virtually air tight seal, substantially blocking the escape of any evaporated volatiles from the interior of base 23.

Sealing Engagement of Cam and Inner Body

A shell-cam assembly 33–34 extends distally upward above the lower proximal end of the inner body 29. This assembly comprises a tubular shell 33 customarily of thin metal such as aluminum, having a tubular open-ended cam 34 whose outer surface is fixedly anchored to the inner surface of the shell 33. The cam 34 is customarily formed of a polymer such as polystyrene or the like, and its inner surface defines one or two shallow helical grooves 36, as shown in FIGS. 1, 2, 4 and 7.

Shell 33 is often termed an "A-shell" in the industry, and it extends distally beyond cam 34, as clearly shown in FIGS. 1, 3, 4 and 5. The proximal end 37 of cam 34 extends downward beyond the proximal end 38 of shell 33, for contact with a bevelled shoulder 39 extending outward from the periphery of inner body 29 (FIG. 2).

Figure 2:
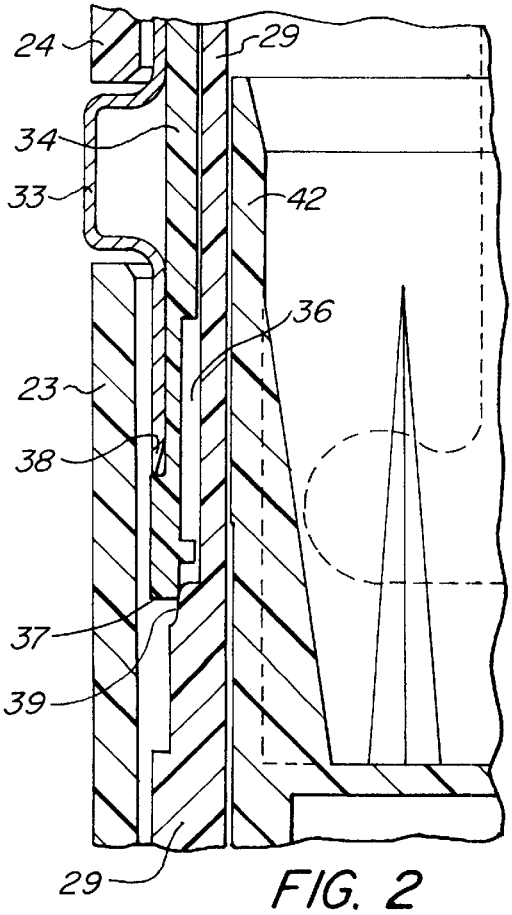
FIG. 2 is a fragmentary, greatly enlarged cross-sectional elevation view of the left central portion of FIG. 1.

As shown in FIGS. 1 and 2, inner body 29 is provided with one or two longitudinal slots 41 extending downward to closed proximal ends near the level of shoulder 39 on inner body 29. One slot 41 may have an open distal end.

A pomade elevator carrier or cup 42 is longitudinally movable inside inner body 29, from a proximal pomade-retracted position shown in FIG. 1 to a distal pomade-extended position shown in FIG. 4. The pomade stick 43 is shown in dashed lines in both of these Figures.

Elevator cup 42 is provided with one or two radially extending short lugs or studs 44 protruding from cup 42 through a longitudinal slot 41 in inner body 29 into "cam-follower" engagement with the helical groove 36 formed on the inner surface of cam 34.

Shell-cam assembly 33–34 is mounted for relative "swiveling" rotational movement on inner body 29, whose shoulder 39 and a radially protruding distal rim 46 (FIGS. 3 and 5) serve to limit longitudinal play between assembly 33–34 and inner body 29.

Rotation of shell-cam assembly 33–34 relative to inner body 29 about their common longitudinal axis 47 causes lugs 44 to be guided upward by helical cam groove 36, elevating lugs 44 distally along longitudinal slots 41 in inner body 29 (FIGS. 1 and 4). Customarily two lugs 44 riding in two slots 41 guided by two cam grooves 36 provide balanced longitudinal motion of cup 42, avoiding undesired rocking or jamming of cup 42 during advancing and retracting movement of pomade stick 43.

Figure 8:
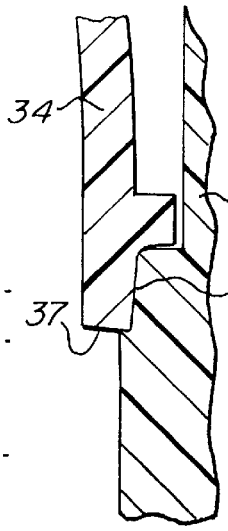
FIG. 8 is a schematic view corresponding to FIG. 7, showing the tight telescoping proximal engagement of cam and inner body when the base-cap container is firmly closed.

The sealing engagement of proximal cam rim 37 with shoulder 39 (FIGS. 2, 7 and 8) is assured by the action of cap 24 when it is installed by the user on the pomade-retracted base assembly shown in FIG. 1. Both of the different caps 24 shown in the Figures urge shell 33 downward, as described below. Shell-cam assembly 33–34 is thereby driven downward from the contact position with shoulder 39, shown in FIG. 7, to the fully telescoped, deformed position of FIG. 8. Both cam 34 and inner body 29 are generally formed of polystyrene or other polymers, and they are stiff but resiliently deformable, assuring tight sealing engagement. This virtually blocks the escape of volatiles, from the pomade carried in cup 42 inside inner body 29, past cam 34 to the space inside base 23 and thence to the surrounding atmosphere.

In the preferred embodiments, the outer surface of shoulder 39 is bevelled or tapered to an angle A between about 9° and about 15° from the longitudinal axis 47 direction, and ideally falls between 10° and 13°. It is believed that angles A between about 5° and about 20° provide effective sealing telescoping deformed engagement and increase the force required for cup push back.

FIGS. 9 and 10 are schematic diagrams of an inverted pair of interferingly telescoping annular components, with the descending upper rim having an outward facing conical bevel 48 at an angle A, and the lower "shoulder" 49 having a contact face 49 defining a cylindrical surface whose generatrix is parallel to longitudinal axis 47, spaced at a contact radius $R_3$ therefrom. Radius $R_3$ falls between the maximum radius $R_1$ and the minimum radius $R_2$ of the conical bevelled surface 48, assuring that contact of surface 49 with bevel 48 will produce telescoping sealing deformation of both components, as shown in FIG. 10.

The schematic diagrams of FIGS. 11 and 13 illustrate similar engagement of telescoping surfaces both having conical bevelled engaging surfaces of two different angles. In each case the surface having the steeper slope and smaller angle B engages the less steeply bevelled surface at a contact radius $R_3$ falling between maximum radius $R_1$ and minimum radius $R_2$ of the contacted surface having the greater angle A, assuring the desired telescoping deformation of both components.

In FIGS. 7 and 9, there is no angle B because it is zero; in FIGS. 11 and 13, the difference between angles A and B determines the extent of the consequent resilient deformation, indicated in engaged diagrams 12 and 14.

In all of these diagrams of FIGS. 7 through 14, if the maximum radius $R_1$ occurs at a radial ledge or shoulder, this abutment limits the telescoping engagement and also the extent of resilient deformation.

Container Cap and Internal Cap Insert

Both forms of the container cap 24 are provided with internal cap inserts 21 or 22. These inserts are similar, but perform their sealing function in different ways.

They are fabricated of high density polyethylene or polypropylene or other similar polymers, and they are therefore notably more flexible and less rigid than the caps, which are customarily made of medium impact styrene, styrene acrylonitrile (SAN) or acrylonitrile butadiene styrene (ABS). Inserts 21 and 22 may be anchored inside caps 24 by adhesive or a ring-and-groove snap-fit assembly like 28–32, but they are customarily made oversize, with an outside diameter several thousandths of an inch larger than the inside diameter of the cap in which they are mounted.

In the cap insert 21 shown in FIGS. 1 and 3, the outer rim 51 of the insert depends from the distal end of the insert to form a tapered outer skirt, whose narrower proximal end 52 extends between the interior wall of cap 24 and the outer surface of shell 33. The thickness of proximal end 52 of outer rim 51 is slightly greater than the radial clearance between cap 24 and shell 33. This results in a resiliently compressed airtight seal blocking the escape of volatiles from the interior of shell-cam assembly 33–34 past cap 24.

Cap insert 21 also presents an inwardly spaced inner skirt 53, depending from a distal deck 54, whose outer surface extends into interfering frictional engagement with the interior of distal rim 46 of inner body 29, over a frictional engagement zone 56, serving to act as a friction brake preventing rotation of shell-cam assembly 33–34 relative to base-inner body assembly 23–29 when cap 24 is firmly in place, and thus assuring that pomade stick 43 will not be advanced inadvertently into damaging contact with insert 21.

Cap insert 22 (FIGS. 4 and 5) is provided with an oversize outer rim 57 interferingly fitted into the distal interior of cap 24. An annular outer distal deck 58 connects rim 57 to an inwardly spaced depending skirt 59 having no deck at its distal end, but rather a central deck 61 spanning the interior of skirt 59. Deck 61 is positioned at a level corresponding, when cap 24 is firmly mounted, to that of the inturned distal rim 62 of shell 33, and the outside diameter of skirt 59 at this level is slightly greater than the inside diameter of rim 62, producing interfering frictional engagement sealing the interior of shell 33 from the interior of cap 24 and the outside atmosphere. The relative rigidity of central deck 61 stiffens inner skirt 59 and assures firm sealing engagement of skirt 59 with rim 62 of shell 33.

Below deck 61, the inner and outer diameters of the internal skirt are slightly reduced, producing an inwardly stepped sub-skirt 63, whose outer diameter interferingly engages the interior surface of distal rim 46 of inner body 29. This produces interfering frictional engagement with inner body 29 over a zone 56, with the same effect as that produced by skirt 53 of insert 21, for the same purposes.

Thus each of these cap inserts 21 and 22 seals the distal interior end of the shell and the proximal interior end of the cam to produce a virtually airtight sealed enclosure around the pomade stick, while also providing with its inner skirt an "anti-free-wheeling" friction brake blocking undesired relative rotation of the shell and the base, maintaining the pomade stick in its retracted position.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a pomade stick applicator of the type having a substantially right cylindrical tubular shell having open proximal and distal ends and an inner and an outer surface, a substantially right cylindrical cam having open proximal and distal ends coaxially and fixedly housed within said shell and thereby forming a shell-cam assembly having a common longitudinal axis, said cam having an outer surface adjacent the inner surface of said shell and an inner surface defining a helical cam groove, an inner body coaxially housed within said cam having a proximal end extending beyond the open proximal end of said shell, said inner body defining a longitudinal groove substantially parallel to the common longitudinal axis of said shell-cam assembly, said inner body being rotatable relative to said cam about said longitudinal axis, and an elevator carrier cup for said pomade stick housed and longitudinally movable within said inner body, said elevator carrier cup having a lug extending through said longitudinal groove and into said cam groove whereby said elevator carrier cup is caused to advance from the proximal to the distal end of the shell along said common longitudinal axis upon relative rotation between said inner body and said cam to extend said pomade stick from the open distal end of the shell, and upon relative counter-rotation between said inner body and said cam to retract the pomade stick within the shell, the improvement comprising a two-part base-cap container including:

a right cylindrical base having a closed proximal end, embracing the proximal end of the rotatable inner body in torque-transmitting relationship to produce said relative rotation, with rib-and-groove means encircling the proximal end of the inner body inside said base with a snap fit sealingly anchoring the base on the inner body, and a right cylindrical cap having a closed distal end, sized for substantial telescoping engagement with the distal end of the cylindrical shell, and incorporating first resilient sealing means providing resiliently deformable interfering engagement with said inner body and substantially airtight sealing contact between said shell-cam assembly and said two-part base-cap container when said pomade stick is retracted within said shell, and further including additional resilient sealing means incorporating:

a resilient deformable proximal rim formed on the proximal end of said cam and extending beyond the proximal end of said shell into overlapping engagement with the proximal end of said inner body, a resilient deformable shoulder formed on the inner body and protruding interferingly into deformed contact with said cam rim during said overlapping engagement, and bevelled ramp means operatively positioned between said cam rim and said inner body shoulder, whereby longitudinal force applied by a user urging said cam rim and the said inner body shoulder into progressively greater overlapping engagement produces progressively greater deformation of both cam rim and shoulder as overlapping engagement increases long said ramp means.

2. The pomade stick applicator defined in claim 1 wherein the bevelled ramp means includes:

a first outer overlapping surface facing inward on one of said inner body and said cam rim, a second inner overlapping surface facing outward on the other of said inner body and said cam rim, one of said overlapping surfaces being provided with a conical bevel, between a minimum diameter and a maximum diameter defining an acute bevel angle A relative to the common longitudinal axis, bracketing the average diameter of the other overlapping surface, whose maximum and minimum diameters define a bevel angle B relative to said axis smaller than angle A, whereby said overlapping surfaces increasingly deflect each other as said overlapping engagement progresses.

3. The pomade stick applicator defined in claim 2 wherein angle B=zero.

4. The pomade stick applicator defined in claim 2 wherein angle A exceeds angle B by a value between about 5° and about 20°.

5. The pomade stick applicator defined in claim 2 wherein angle A exceeds angle B by a value between about 9° and about 15°.

6. The pomade stick applicator defined in claim 1 wherein the ramp means comprises a convex bevelled outer rim edge formed on said shoulder aligned to deflect said cam rim in increasing resilient deformation as said overlapping engagement progresses.

7. The pomade stick applicator defined in claim 1 wherein the ramp means comprises a concave bevelled inner edge formed on said cam rim aligned to deflect said cam rim in increasing resilient deformation as said overlapping engagement progresses.

8. The pomade stick applicator defined in claim 1, wherein the first resilient sealing means includes a resilient inner collar insert anchored inside the closed distal end of the cylindrical cap and dimensioned to engage the open distal end of the tubular shell in substantially airtight sealing engagement when the pomade stick is retracted and the cap is positioned in substantial telescoping engaged position on said shell to the maximum possible extent, and wherein said resilient inner collar insert includes a depending skirt inwardly offset from the interior surface of said cap having an inner surface and an outer surface and sized for interfering telescoping engagement of its outer surface with the inner surface of the distal end of the inner body when the cap is positioned in substantial telescoping engaged position on said shell to the maximum possible extent, whereby said interfering telescoping engagement creates frictional resistance to said relative rotation, resisting inadvertent "free-wheeling" advance of the pomade stick until the cap is removed from the shell, and avoiding undesired damage to said pomade stick.

9. The pomade stick applicator defined in claim 8 wherein said inner collar insert is sealingly sandwiched between the interior of said cap and the outer surface of said shell at its distal end in said substantial telescoping position of said cap.

10. The pomade stick applicator defined in claim 8 wherein said depending skirt has its outer surface dimensioned for resilient sealing contact with an inner rim edge of the shell's open distal second end in said substantial telescoping position of said cap.

11. The pomade stick applicator defined in claim 10, wherein the inner collar insert further includes an unbroken transverse deck platform extending across the region inside said depending skirt, substantially aligned with the inner rim edge of the shell's open distal end, resisting resilient deformation of the skirt to insure its sealing contact with the shell's inner rim edge in said substantial telescoping position of said cap.

* * * * *